United States Patent [19]

Novo

[11] Patent Number: 4,479,413

[45] Date of Patent: Oct. 30, 1984

[54] SAXOPHONE NECK GREASE PLUG

[76] Inventor: Juan Novo, 12440 SW. 188 Ter., Miami, Fla. 33177

[21] Appl. No.: 514,651

[22] Filed: Jul. 18, 1983

[51] Int. Cl.[3] ..... G10D 9/00; G10G 7/00

[52] U.S. Cl. ..... 84/329; 84/385 R; 84/453

[58] Field of Search ..... 84/329, 380 R, 385 R, 84/453

[56] References Cited

U.S. PATENT DOCUMENTS

| | | | |
|---|---|---|---|
| 1,137,414 | 4/1915 | Mollenhauer et al. | 84/329 |
| 1,761,329 | 6/1930 | Charlton | 84/380 R |
| 3,726,173 | 4/1973 | Cortez | 84/388 |
| 4,378,724 | 5/1983 | Lamart | 84/465 |

OTHER PUBLICATIONS

Catalog #66, David Wexler & Co., pp. 71, 73, 1965.

*Primary Examiner*—Lawrence R. Franklin
*Attorney, Agent, or Firm*—John Cyril Malloy

[57] ABSTRACT

A saxophone neck grease plug for use in storing a saxophone after use which comprises a body defined by an upper portion and a lower portion with the upper portion defining a hollow cavity which is charged with grease and closed with a cap, the lower portion having a smaller diameter than the upper portion consisting of flexible fingers for telescopic insertion into varied sized saxophone neck sockets.

12 Claims, 5 Drawing Figures

SAXOPHONE NECK GREASE PLUG

BACKGROUND OF THE INVENTION

1. Field of the Invention

This invention relates to devices used to cap the neck socket of a saxophone for storage after use. More particularly this invention relates to a device for use in caping a saxophone neck socket for storage after use combining the functions of a saxophone neck plug and a grease holder.

2. Description of the Prior Art

In the past there have been numerous types of plugs for a saxophone neck socket replacing the neck when it is removed and the saxophone is to be stored after use. Plugs consisting of cork, rubber and plastic have generally been used and have served no other purpose than to simply close off the opening in the saxophone neck socket where the neck is inserted. With every saxophone there is a separate container which holds cork grease which is usually carried inside the saxophone case. When the saxophone is ready to be used, the musician will remove the plug and reach for his container of cork grease, open the container and grease the male mating portion of the neck wrapped with cork for the insertion of the mouthpiece. Thus, there are several steps involved in preparing the saxophone for use. Each step in turn requires several motions including the removal of the plug, reaching for the container of grease, opening the container of grease, and greasing the necessary parts of the saxophone neck.

SUMMARY OF THE INVENTION

This invention avoids the motions of removing the plug and reaching for the container of cork grease and makes the tedious task of greasing the mating portions of the saxophone more simplified by conveniently locating the grease in the saxophone neck plug. The musician simply removes the grease plug, removes the cap of the grease plug and greases the mating portions. The musician does not have to look or reach for a can of grease. The grease is conveniently contained in the "grease plug" for his immediate use.

This invention consists of a plug having an upper and lower portion. The lower inside portion having a diameter substantially equal to the diameter of the saxophone neck socket at the lip of the neck socket and having diametrical slots extending diametrically which define flexible fingers for telescopic insertion into the saxophone neck socket. The lowermost distal leading end zone of said lower portion defines a frustoconical wall acting as a guide means for telescopic insertion into the neck socket. The upper portion of the plug is preferably cylindrical having an outside diameter equal to or slightly greater than the outside diameter of the lip of the neck socket and defining a hollow cavity having a charge of grease contained therein, a cap having an upper portion spanning the diameter of the upper portion of the plug and a lower portion having a diameter equal to the diameter of the hollow cavity closes off the hollow cavity for maintaining the grease inside the hollow cavity. The flexible nature of the fingers of the lower portion of the plug enables this device to be used on various size saxophone neck sockets. However, the slots of the lower portion of the plug can be eliminated giving the lower portion a specific diameter which permits the plug to only fit a specific diameter neck socket of a saxophone.

The convenience of having the grease in the plug and eliminating unnecessary time in locating the grease container after removal of a standard plug is very significant to the musician who has usually little time to prepare for his or her performance and also because he or she is given one less item to handle and keep track of.

DETAILED DESCRIPTION OF THE PREFERRED EMBODIMENT

Figure 1:
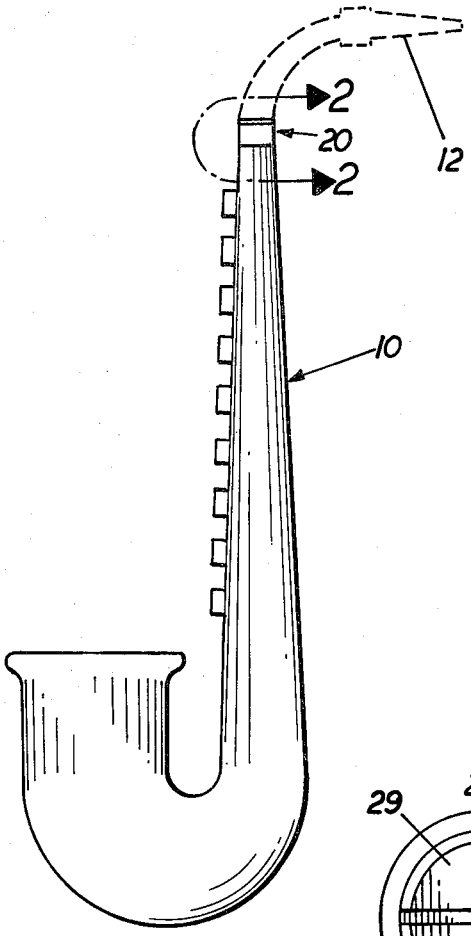
FIG. 1 is a side plan view of the saxophone neck grease plug showing the saxophone, neck, mouthpiece and grease plug.
Figure 2:
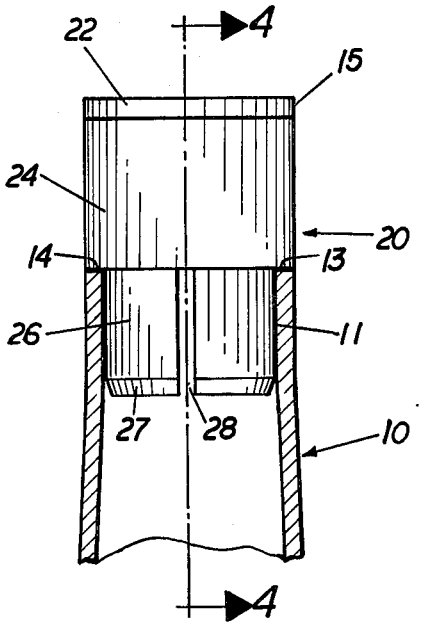
FIG. 2 is a cross section view taken at section lines indicated in FIG. 1.
Figure 5:
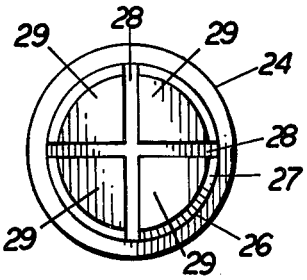
FIG. 5 is a bottom view of the invention.
Figure 3:
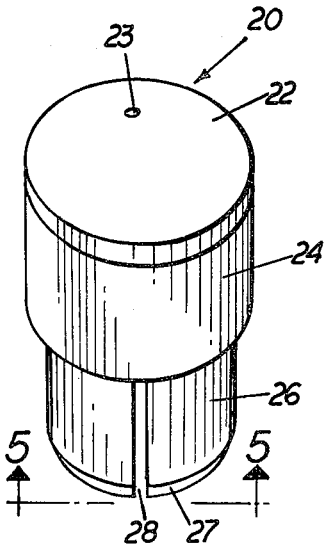
FIG. 3 is a perspective view of the invention.
Figure 4:
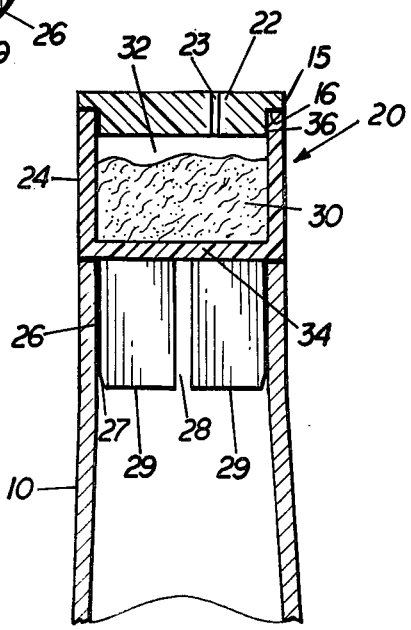
FIG. 4 is a cross section view taken at the section lines indicated in FIG. 2.

With reference to the drawings in which like reference characters designate like or corresponding parts throughout the various views and with particular reference to FIGS. 2 through 4, the grease plug of the present invention designated generally at 20 is comprised of a body defining an upper portion 24 and a lower portion 26 and a cap 22. As best shown in FIG. 4, the upper portion defines a hollow cavity 32 bounded by a cylindrical sidewall 16 and a floor 34. The hollow cavity has a charge of grease 30 contained therein. The floor 34 spans the width of the saxophone neck socket 10 and rests on the open rim of the neck socket 10.

Again, as best shown in FIG. 4, the lower portion 26 has a smaller diameter than the upper portion 24 with a shoulder 13 being defined where the upper and lower portions meet for resting engagement on the lip 14 of the neck socket 10. As best shown in FIGS. 2 and 3, the distal lowermost leading end zone of the lower portion 26 defines a frustoconical wall 27 which acts as guide means for captivation of the flexible fingers 29 separated by a diametrical slots 28 extending symmetrically to the plane of said shoulder 13 for telescopic insertion into the neck 10.

As best shown in FIG. 4 and FIG. 2, a cap 22 covering the hollow cavity 32 defines a circular rim 15 spanning an upper portion 24 and a bottom portion 36 of reduced diameter equal to the diameter of the hollow cavity. The bottom portion 36 of the cap 22 is sized to be snugly received between the sidewall 16. As shown in FIG. 4, the cap 22 has a breather hole 23 defined by a through hole of a small diameter to permit air to escape when the cap is received by the upper portion 24.

Although the sidewall 16 is cylindrical in the preferred embodiment depicted in the drawings, the invention is not limited to this geometry and it is understood that the geometry of the sidewall can be triangular, rectangular or any other shape providing there is a shoulder defined where the lower portion meets the upper portion for resting engagement on the lip of the neck socket.

What is claimed is:

1. A saxophone neck grease plug for use in storing a saxophone after use comprising:

a body defining an upper portion and a lower portion, said upper portion defining a hollow cavity and a floor, said floor spanning the width of the saxophone neck socket, said hollow cavity having a charge of grease contained therein, said lower portion having a diameter substantially equal to the diameter of the lip of the saxophone neck socket with a shoulder being defined where the upper and lower portions meet for resting engagement on the lip of the neck socket of the saxophone, a cap defining a rim spanning the upper portion of the body and a bottom portion equal to the inside dimensions of the hollow cavity of the upper portion sized to be snugly received by the hollow cavity, said cap having a breather hole defined by a through-hole of a small diameter to permit air to escape when the cap is received by the upper portion.

2. The device as set forth in claim 1 wherein said lower portion defines flexible fingers separated by diametrical slots extending symmetrically to the plane of said shoulder.

3. The device as set forth in claim 2 wherein said upper portion is rectangular defining a diagonal distance between the corners of said rectangle that is equal to or slightly greater than the outside diameter of the lip of the saxophone neck socket.

4. The device as set forth in claim 2 wherein the lowermost distal leading end zone of said lower portion defines a frustoconical wall acting as a guide means for telescopic insertion into the saxophone neck socket.

5. The device as set forth in claim 4 wherein said upper portion is cylindrical with an outside diameter equal to or slightly greater than the outside diameter of the lip of the saxophone neck socket.

6. The device as set forth in claim 4 wherein said upper portion is rectangular defining a diagonal distance between the corners of said rectangle that is equal to or slightly greater than the outside diameter of the lip of the saxophone neck socket.

7. The device as set forth in claim 2 wherein said upper portion is cylindrical with an outside diameter equal to or slightly greater than the outside diameter of the lip of the saxophone neck socket.

8. The device as set forth in claim 1 wherein the lowermost distal leading end zone of said lower portion defines a frustoconical wall acting as a guide means for telescopic insertion into the saxophone neck.

9. The device as set forth in claim 8 wherein said upper portion is cylindrical with an outside diameter equal to or slightly greater than the outside diameter of the lip of the saxophone neck socket.

10. The device as set forth in claim 8 wherein said upper portion is rectangular defining a diagonal distance between the corners of said rectangle that is equal to or slightly greater than the outside diameter of the lip of the saxophone neck socket.

11. The device as set forth in claim 1 wherein said upper portion is cylindrical with an outside diameter equal to or slightly greater than the outside diameter of the lip of the saxophone neck socket.

12. The device as set forth in claim 1 wherein said upper portion is rectangular defining a diagonal distance between the corners of said rectangle that is equal to or slightly greater than the outside diameter of the lip of the saxophone neck socket.

* * * * *